United States Patent [19]

Huang et al.

[11] Patent Number: 4,558,742

[45] Date of Patent: Dec. 17, 1985

[54] METHOD AND APPARATUS FOR GRAVEL PACKING HORIZONTAL WELLS

[75] Inventors: Wann-Sheng Huang; Alfred Brown, both of Houston, Tex.

[73] Assignee: Texaco Inc., White Plains, N.Y.

[21] Appl. No.: 630,506

[22] Filed: Jul. 13, 1984

[51] Int. Cl.[4] ..... E21B 43/04

[52] U.S. Cl. ..... 166/278; 166/51

[58] Field of Search ..... 166/51, 50, 278

[56] References Cited

U.S. PATENT DOCUMENTS

| | | | |
|---|---|---|---|
| 2,652,117 | 9/1953 | Arendt et al. | 166/278 |
| 3,556,219 | 1/1971 | Meldau | 166/278 |
| 3,770,054 | 11/1973 | Solum | 166/51 |
| 4,469,178 | 9/1984 | Solum | 166/51 |

FOREIGN PATENT DOCUMENTS

| | | | |
|---|---|---|---|
| 870527 | 3/1953 | Fed. Rep. of Germany | 166/50 |

*Primary Examiner*—Stephen J. Novosad
*Assistant Examiner*—M. Goodwin
*Attorney, Agent, or Firm*—Robert A. Kulason; James J. O'Loughlin; Robert B. Burns

[57] ABSTRACT

A well completion and the method therefor for a wellbore which extends generally horizontally of a subterranean layer comprised primarily of unconsolidated sand particles which hold a viscous hydrocarbon. The completion includes an elongated perforated liner which is positioned in the wellbore. The liner is substantially surrounded by a gravel pack which functions to limit the amount of sand particles which are carried from the subterranean layer into the liner in response to the introduction of a flow of a hot stimulating fluid into the substrate.

5 Claims, 6 Drawing Figures

METHOD AND APPARATUS FOR GRAVEL PACKING HORIZONTAL WELLS

BACKGROUND OF THE INVENTION

In the production of hydrocarbons, such as crude oil and bitumen from a subterranean reservior, the characteristic of the formation has a substantial affect on the efficiency of production. It is expected that in the course of most production operations, the flowing hydrocarbon will carry with it an amount of the substrate from which it is being lifted. This effect is particularly noticeable in the instance of sandy formations which are subjected to thermal stimulation.

In the instance of a substrate comprised largely of unconsolidated sand particles, the flowing hydrocarbon will tend to carry excessive amounts of sand with it. Sand thus entering the well casing or liner, forms a substantial part of the flow and has detrimental effects on the overall operation, as well as on the equipment. For example, the size of the sand particles could be such that there is a propensity for it to block or at least partially plug holes and passages through which the flow passes. Further, the abrasive nature of the sand results in the wearing away or damage to parts which make up the well completion.

Operationally, the combined sand and hydrocarbon flow have to be treated and separated after being produced. The equipment needed for such separation generally constitutes a major and costly part of the production facility in which sand is a prevalent factor.

It can be appreciated that in the instance of bitumen production, and the production of viscous crude oil from a sandy environment, the problem of sand control will pose a major consideration. In the specific instance of bitumen, the normal thermal stimulation of a substrate through the use of hot fluids such as steam, will tend to promote the flow of sand. As the bitumen or viscous crude is released, it will carry along with it varying sized sand particles in its flow to the production string.

It has been found that where the hydrocarbon holding reservoir constitutes a relatively thin layer, there are advantages in the use of horizontal wells. The latter extend coextensively with the productive layer and can be more economical than a series of vertical wells, which pass through the layer at spaced apart points.

In the instance of a horizontal well, similarly to a vertical well, a pressurized hot medium is used to stimulate the substrate adjacent to the well. Thereafter the viscous hydrocarbon is caused to flow and gravitate toward the single well, and be produced as a hot, flowing stream.

In the instance of horizontal wells which are formed into tar sands, the problem of excessive sand production is particularly acute. As above noted, the hot bitumen is stimulated and caused to assume a fluid state, thereby carrying with it substantial quantities of sand which will enter the wall perforations in the horizontally positioned liner. These sand particles will tend to narrow such passages to a minimum opening, or completely obviate flow therethrough.

Efforts have been made through the use of replaceable screens, to minimize this flow of sand into a horizontal producing well. However, the very nature of the well, because it entends horizontally rather than veritcally, introduces problems not heretofore contemplated with respect to the in-situ formation of a suitable gravel pack. Since a gravel pack is among the most prevalent ways of minimizing sand production in vertical wells, such packs are considered to be of comparable efficiency if they can be adapted to be utilized in conjunction with a horizontal well.

The state of the art relative to in-situ gravel packing of hydrocarbon producing wells covers a broad spectrum of apparatus and methods. Essentially, however, the art is concerned primarily with packing of vertical and/or deviated wells, with open or closed casing, in which the gravel injection can be achieved by a gravity flow.

Examples of this type of gravel packs are disclosed in U.S. Pat. Nos. 4,066,127 and 4,124,074. In the shown patents, the gravel is introduced through the well and carried into a preformed vertical well cavity whereby to constitute the required sand barrier. This introduction of the gravel is achieved either by feeding the gravel alone, or in the form of a slurry.

In U.S. Pat. No. 2,434,239, the patentee extends the gravel pack concept into a portion of a deviated or sloping well, and even into a portion of a horizontal well. However the gravel as shown, particularly in the patentee's FIG. 3, is introduced to fill the entire borehole. This is achieved by progressively withdrawing the gravel carrying conduit as the borehole fills. The patentee's disclosure lacks the means for providing a gravel pack which surrounds the well liner and forms the necessary peripheral barrier to sand.

U.S. Pat. No. 3,261,401 is concerned at least in part with a gravel pack within a horizontal well. The pack in this instance, and as shown in FIGS. 4 and 5, is an integral part of the well liner, and is not installed in-situ.

Toward overcoming the foregoing problems, and for providing an in-situ gravel pack, the disclosed well completion is one that is commenced by first forming an elongated bore. The latter extends substantially horizontally whereby to lie longitudinally through a productive layer.

A perforated well liner or casing having a diameter substantially less than the diameter of the wellbore, is supportably positioned in the bore in a manner to define an annular passage. Said passage between the liner wall and the adjacent wall of the bore, is then furnished with a gravel pack. The pack is comprised of an unconsolidated mass of gravel sizes and grades which have been predetermined for the particular formation composition, to best form a barrier to migrating sand particles which would otherwise enter the liner.

The gravel pack annular cavity or longitudinal passage is formed by positioning the liner initially in the wellbore prior to introducing a gravel carrying slurry to said longitudial passage. Thereafter, the pack is completed by introduction of the gravel slurry about the liner sides as a slurry carrying conduit is progressively withdrawn from the well.

It is therefore an object of the invention to provide a gravel pack and method for use thereof in a substrate comprising a sandy composition and into which at least one horizontal producing well has been formed.

A further object is to provide a method for forming a gravel pack in situ about a horizontally extending well.

A still further object is to provide a gravel pack and method for applying the same about a well liner that is positioned in a horizontally extending wellbore.

Figure 1:
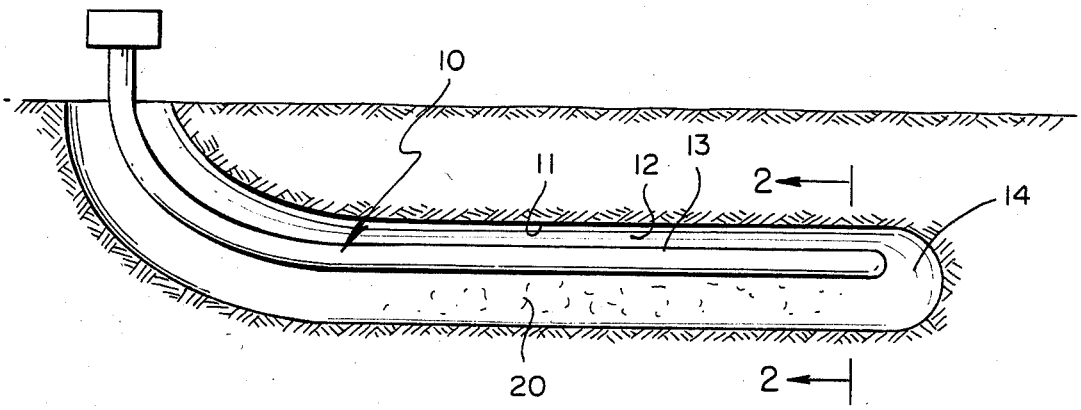
FIG. 1 is a cross-sectional elevation view of a horizontal, gravel packed well completion.
Figure 2:
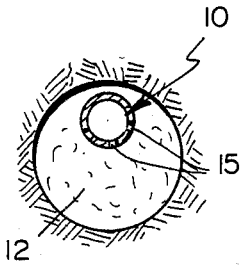
FIG. 2 is a sectional view taken along line 2—2 in FIG. 1.
Figure 3:
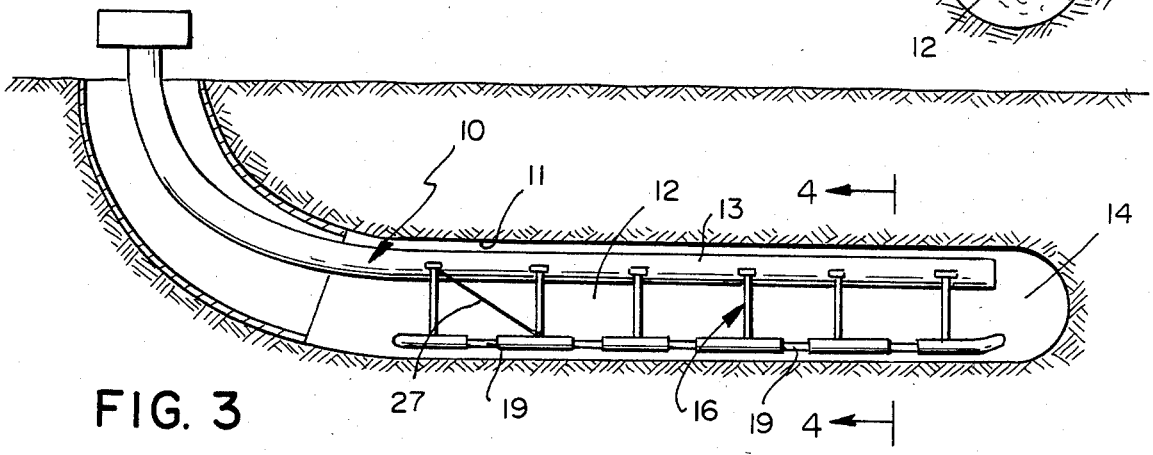
FIG. 3 is similar to FIG. 1, prior to the gravel being placed.

Referring to the Figures, a well completion 10 of the type contemplated is shown positioned in a generally horizontal disposition within a wellbore 11 in a substrate 20 comprised of a sandy composition.

Normally a producing well of this type is formed by commencing the wellbore 11 at the surface, either in a vertical or a downward slanted direction. Thereafter, at the productive layer, the well is diverted to extend in a substantially horizontal direction.

Preferably, wells of this configuration are employed where the productive substrate comprises a relatively thin layer. They can, however, also be used in producing thick layers. Thus, the wellbore 11 can extend for any desired distance along the layer to best provide the stimulating medium for heating the viscous hydrocarbon, and for carrying away the resulting hydrocarbon emulsion or mixture.

Horizontal wells of the type shown can be utilized by themselves as a production means. Alternatively, a series of horizontally extending wells cooperatively arranged, can be employed to supplement the function of each other through sequential thermal stimulation and production steps.

In the present arrangement, and to illustrate the invention, the novel grave pack 12 and its method of application will be described with respect to a single horizontally extending well which is positioned in a tar sand environment for producing a bitumen emulsion.

In a normal tar sand layer, the formation is comprised of different sand particle sizes with the bitumen retained therebetween. The bitumen, however, is too thick or viscous to flow without thermal stimulation such as by steam or hot water injection into the formation.

Horizontal wellbore 11 is provided with a liner or casing 13 which is positioned within bore 11. The liner carries the dual purpose of introducing a heating medium to the surrounding substrate, and producing the resulting bitumen emulsion. Liner 13 is therefore provided with openings such as perforations or slots 15 formed in the wall thereof. The latter are of a size capable of permitting an outflow of a heating medium such as steam, and the resulting inflow of the hot bitumen emulsion.

As herein mentioned, inflowing bitumen usually results in the presence of substantial amounts of varied size sand particles. The latter, depending on their size, will accumulate and clog or impair flow through the relatively constricted liner wall openings 15.

Were these openings to be made larger to accommodate the flow of sand without promoting a blocking action, the excessive sand build-up would soon function to impede operation of downstream equipment such as pumps, separators, and the like.

Elongated steel liner 13 is prepositioned within wellbore 11 to best achieve the desired filtering action whereby to minimize sand flow through liner perforation 15. Thus, and as shown in FIG. 1, in one embodiment liner 13 is positioned adjacent to or contiguous with the upper side of the wellbore 11. The subsequently installed gravel pack 12 will thereby fill the annulus defined by the adjacent walls of said liner and bore.

In the illustrated configuration, to achieve maximum filtering action liner 13 can be provided with narrow slots or openings 15 for only a portion of the wall periphery. These would be found adjacent to the lower side of the liner. Inflowing bitumen emulsion will thereby by caused to pass through the thicker portions of the gravel pack and sustain the desired sand filtering action prior to bitumen emulsion entering the wall openings.

Gravel pack 12 as shown, is preferably installed in a manner that it fills the forward space 14 of wellbore 11 between the bore end wall, and the end of liner 13. In effect the gravel pack will fill all paths along which hot bitumen will flow as it moves toward the liner.

To properly position liner 13 at a desired elevation within bore 11, the liner is provided with means for supporting it along its length at the desired elevation. Since the liner must be slid or pulled into bore 11 subsequent to formation of the latter, the support means includes a sled-like assembly 16 which depends from the lower end of the liner.

Sled or skid assembly 16 includes a plurality of spaced apart slide or track members 17 and 18 which contact the walls of the wellbore 11. Liner 13 can thereby be urged into the bore by being pushed downwardly from the surface. Alternatively, liner 13 can be pulled into place where a supplementary well is drilled to intersect the remote end of wellbore 11. Such method, however, constitutes a less convenient way to place the liner.

Figure 4:
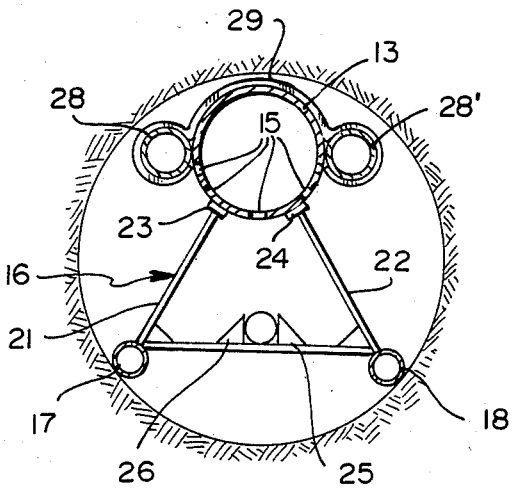
FIG. 4 is a sectional view taken along line 4—4 of FIG. 3.
Figure 5:
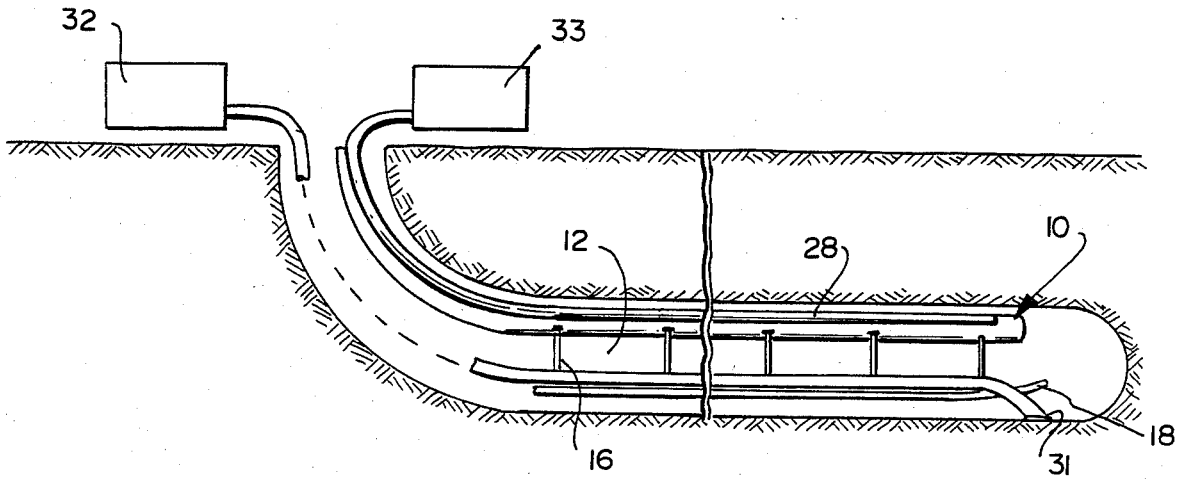
FIG. 5 is a vertical cross sectional view of an alternate embodiment of the invention.
Figure 6:
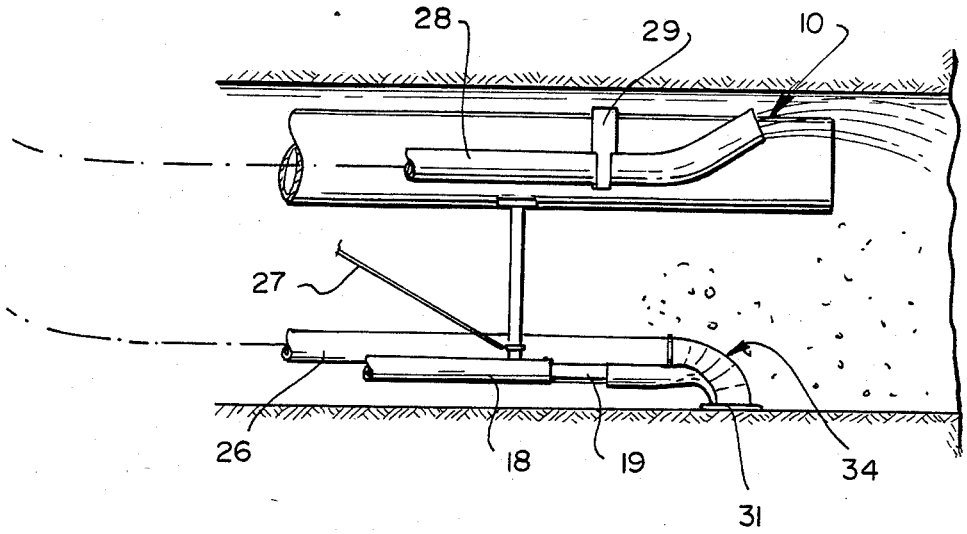
FIG. 6 is a segmantary view in cross section of an alternate embodiment of a horizontal well.

As shown in FIGS. 4, 5 and 6, skid assembly 16 includes said at least two tubular elongated slide members 17 and 18. These parallel members extend for substantially the horizontal length of liner 13 where it will be supported within the bore.

Since liner 13 may require a degree of flexibility to be properly positioned, skids 17 and 18 can be formed of tubular segments which are connected at a telescoping joint 19. This arrangement will permit both the liner and skids to readily conform with curvatures in the bore 11 during insertion.

The forward end of the respective skid members is bent upwardly to facilitate movement of the skid assembly through bore 11. The forward end will thus be precluded from digging into the bore wall, an action that could impede its forward movement while being urged into place.

A plurality of substantially vertical support braces 21 and 22 extend between, and are connected to the respective skids 17 and 18, and liner 11. The latter in turn is provided with a collar or a plurality of support pads 23 and 24 which engage the vertical braces.

A further lateral bracing member 25 is provided at the juncture between skid 17 and 18, and support brace 21 and 22. Said lateral element comprises a cross piece disposed transversely of bore 11, to space the skids as well as to support a liquid return conductor 26.

To add rigidity to the support assembly, each adjacent set of vertical braces 21 and 22 can be provided with intermediate stringers 27. The latter extend from the skid member to the connecting pad of the next vertical brace.

Insertion of the liner 11 and skid assembly 16 will necessitate a limited degree of bending action in the liner as well as in the skid members. Stringers 27 between adjacent vertical members can be of the flexible type such as flexible cable or the like which would afford the necessary degree of movement. Further, the elongated skids 17 and 18 as noted can be segmented, affording them a degree of articulation. Thus, any bending of liner 13 will eprmit the skids to compensate by adjusting their length at joint 19. This flexibility between liner and skid avoids resistance to inward or outward movement of the liner through wellbore 11.

To facilitate introduction of gravel slurry into bore 11, skid assembly 16 is provided with at least one slurry conduit 28 and preferably with a second conduit 28'. These members are capable of conducting gravel slurry from the surface, down into the wellbore. Thus, slurry conduits 28 and 28' are releasably connected to skid assembly 16, or liner 13, prior to the latter being inserted into bore 11. To facilitate this movement, the foward end of conduit 28 is connected to the skid or to the wall of liner 11. The conduits will thereby be carried through bore 11 without being displaced. Thereafter, by releasing the conduits they can be withdrawn from bore 11 leaving skid 16 in place, while depositing the gravel slurry into the wellbore.

As the gravel pack is built up about the liner, conduits 28 and 28' are progressively withdrawn along the liner while the latter remains in place. Conduits 28 and 28' as shown in FIGS. 4 and 6 are supported by a transverse bracket or similar means. In one embodiment, the respective conduits 28 and 28' are connected by common strap 29 which extends across the top of liner 11 and is slidably supported thereon to permit both conduits to be simultaneously moved rearward with respect to the liner.

The gravel slurry as it leaves slurry pump 33, will normally comprise a mixture of gravel, together with a carrier fluid such as water. Means is provided therefore for removing the water after it has achieved its purpose. This will leave the gravel positioned about the liner 11 periphery, and yet not inundated. Where the formation is sufficiently porous to permit the water to drain off naturally, the induced drainage is unnecessary.

Toward evacuating water from borehole 11, at least one liquid return line or conductor 26 is provided on skid assembly 16. Line 26, similarly to the slurry carrying lines 28 and 28', can be detached from the skid assembly 16 after the latter is positioned. Thereafter it is progressively withdrawn along wellbore 11 as the gravel is deposited from the forward end of slurry conduits 28 and 28'. Return line 26 is provided with a screen 31 at the intake end thereof to minimize the ingestion of solids. Said line 26 is communicated with a pump 32 at the surface to promote the controlled withdrawal of the carrier liquid.

To permit withdrawal of line 26, the latter is slidably retained on lateral brace 25. Further, a flexible neck 34 depends from conduit 26 and is movable to facilitate such movement.

Operationally, installation of a gravel pack about any horizontal well liner in an unconsolidated, sandy environment is a prime consideration prior to the initial forming of the well. The composition of the gravel, particularly as to particle size, is best established after core borings and tests have disclosed the formation composition at the well site. Having such information available, gravel within the desired size range can now be prepared for mixture into a water slurry.

Wellbore 11 is formed preferably with standard equipment by drilling downward through the overburden to the required depth at which the hydrocarbon is retained. Thereafter, the drill path is deviated into a horizontal direction within the productive layer.

At this point, a supplementary slanted or vertical well can be drilled to assist in placing liner 11 with its skid assembly 16. Preferably, however, liner 13 with attached skid assembly 16 is pushed into the bore from the surface.

Should a supplementary well be utilized, the forward or remote end of the liner can be connected to a cable which passes upward through the supplemental well. Thereafter the liner can be readily pulled into its desired position within bore 11.

The gravel slurry consisting of gravel, together with the water carrier, is introduced under pressure to the upper end of slurry conduits 28 and 28' by way of pump 33. As the slurry is discharged from the forward end of the respective conduits, the gravel progressively fills cavity 14 and the annular passage between liner 13 and wellbore 11 wall.

The aggregate gravel will accumulate into an unconsolidated mass, and the water will gravitate toward the lowest part of the wellbore 11. At the latter, the screened liquid return conductor 26 will fall to the floor of the bore and be in a position to aspirate and remove the water.

After a period of time, the gravel will be deposited to form bed 12, to a point where it blocks the forward end of the slurry conduits 28 and 28'. This condition will register at pump 32 by an indication of an increase in the back pressure on the slurry conduits.

Such a condition dictates the need to retract the respective slurry conduits 28 and 28' and to thereafter continue with the further deposition of the gravel. As the gravel progressively fills the space about liner 13, both the slurry conduits 28 and 28' as well as return line 26 will as noted be slidably withdrawn along their respective support members.

Over a period of deposition, gravel pack 12 will substantially fill and encircle liner 13, and drained water or carrier will be returned to the surface. Should the formation as noted, be sufficiently porous, slurry water can be permitted to drain into the formation rather than being withdrawn.

With the gravel pack 12 in place, the usual thermal stimulating or preheating of the formation can be commenced, by introduction of steam through liner 13. When the contained bitumen becomes flowable, it will carry an amount of sand with it toward liner 13. As the flow passes through gravel pack 12, the sand will be retained and allow passage of the hydrocarbon.

Although modifications and variations of the invention can be made without departing from the spirit and scope thereof, only such limitations should be imposed as are indicated in the appended claims.

We claim:

1. Well completion for a wellbore formed into a subterranean formation comprised of unconsolidated sand particles which releasably hold a visous hydrocarbon, which wellbore extends substantially horizontally of and coextensively with said subterranean formation, which completion includes;

an elongated perforated well liner registered in said wellbore and spaced from the walls thereof to define an annular chamber therebetween, a gravel pack comprising an unconsolidated mass of particulated gravel which occupies said annular chamber to filter a flow of said viscous hydrocarbon liquid in which sand particles are entrained, and well liner positioning means disposed in said wellbore and supportably engaging said well liner, whereby at least some of said sand particles will be retained in the gravel pack to permit the passage of flowable hydrocarbon through gravel pack and into the perforated well liner, said well liner support means including skid means having at least two laterally spaced apart, and longitudinally continuous skids resting on the wellbore lower wall, and support means extending upwardly from said continuous skids in supporting relationship to said well liner.

2. Well completion as defined in claim 1 wherein said well liner is positioned eccentrically of the wellbore.

3. Well completion as defined in claim 1 wherein said well liner is positioned adjacent to the wellbore upper wall.

4. Apparatus for forming a well completion within a wellbore formed into a subterranean formation comprised of unconsolidated sand particles which releasably hold a viscous hydrocarbon, which wellbore extends substantially horizontally of and coextensively of said subterranean formation, and which completion includes;

an elongated perforated well liner fixedly registered in said wellbore and spaced from the walls thereof to define an annular chamber therebetween, skid means depending downwardly from said liner and supportably positioning the liner relative to the wellbore, a gravel pack comprising an unconsolidated mass of particulated gravel which occupies said annular chamber to filter a flow of said viscous hydrocarbon in liquid form and within said sand particles are entrained, conduit means slidably carried on said elongated perforated well liner for introducing a gravel slurry into said annular chamber to form said gravel pack, and liquid removal conduit means operably carried on said skid means and having an inlet positioned adjacent to the lower wall of said wellbore to receive liquid from said gravel slurry.

5. Method for gravel packing a horizontal well completion formed into a subterranean formation comprised primarily of unconsolidated sands which hold viscous hydrocarbons in a manner to release said hydrocarbons when the subterranean formation is thermally stimulated, which completion includes an elongated well liner having at least one gravel slurry conduit operably depending therefrom, and a suction conduit operably positioned at the wellbore lower wall, which method includes the steps of;

positioning said elongated well liner in a wellbore formed horizontally into said subterranean reservoir, said well liner including at least one gravel slurry conduit which is removably held on the well liner, said gravel slurry conduit having a discharge opening disposed adjacent to the well liner remote end, introducing a gravel slurry flow through said gravel slurry conduit whereby said slurry is deposited in said wellbore forward of the liner to permit gravel to accumulate about the liner, withdrawing said gravel slurry conduit rearwardly along said liner as gravel builds up to enclose said liner, and removing liquid from said wellbore lower wall through said suction conduit.

* * * * *